US006186281B1

(12) United States Patent
Pietrzykowski et al.

(10) Patent No.: US 6,186,281 B1
(45) Date of Patent: Feb. 13, 2001

(54) REMOTE STORAGE AND RESET OF ELEVATOR OVERSPEED SWITCH

(75) Inventors: Chris Pietrzykowski, Avon, CT (US); Gerard Sirigu, Gien (FR); Richard N. Fargo, Plainville; Randy G. Henley, Danbury, both of CT (US); Helmut Schröder-Brumloop, Berlin (DE); Gurumurthi Ravishankar, Canton, CT (US)

(73) Assignee: Otis Elevator Company, Farmington, CT (US)

( * ) Notice: Under 35 U.S.C. 154(b), the term of this patent shall be extended for 0 days.

(21) Appl. No.: 09/283,052

(22) Filed: Apr. 1, 1999

(51) Int. Cl.[7] ..... B66B 5/06
(52) U.S. Cl. ..... 187/287
(58) Field of Search ..... 187/287, 288, 187/276, 289, 373

(56) References Cited

U.S. PATENT DOCUMENTS

| | | | | |
|---|---|---|---|---|
| 632,651 | * | 9/1899 | Johnson | 187/287 |
| 1,182,240 | * | 5/1916 | Bemis | 187/287 |
| 4,923,055 | * | 5/1990 | Holland | 187/109 |
| 5,407,028 | * | 4/1995 | Jamieson et al. | 187/288 |
| 5,565,660 | | 10/1996 | Karner | 187/287 |

* cited by examiner

*Primary Examiner*—Jonathan Salata

(57) ABSTRACT

An elevator overspeed system designed to work as a governor includes a first switch responsive to an overspeed condition and a second, remotely located switch responsive to said first switch. An overspeed elevator control procedure is initiated when one of the first or second switches are tripped. The first switch is automatically re-set after the second switch is tripped. The second switch is manually re-set to re-start the elevator system in normal operation mode.

7 Claims, 1 Drawing Sheet

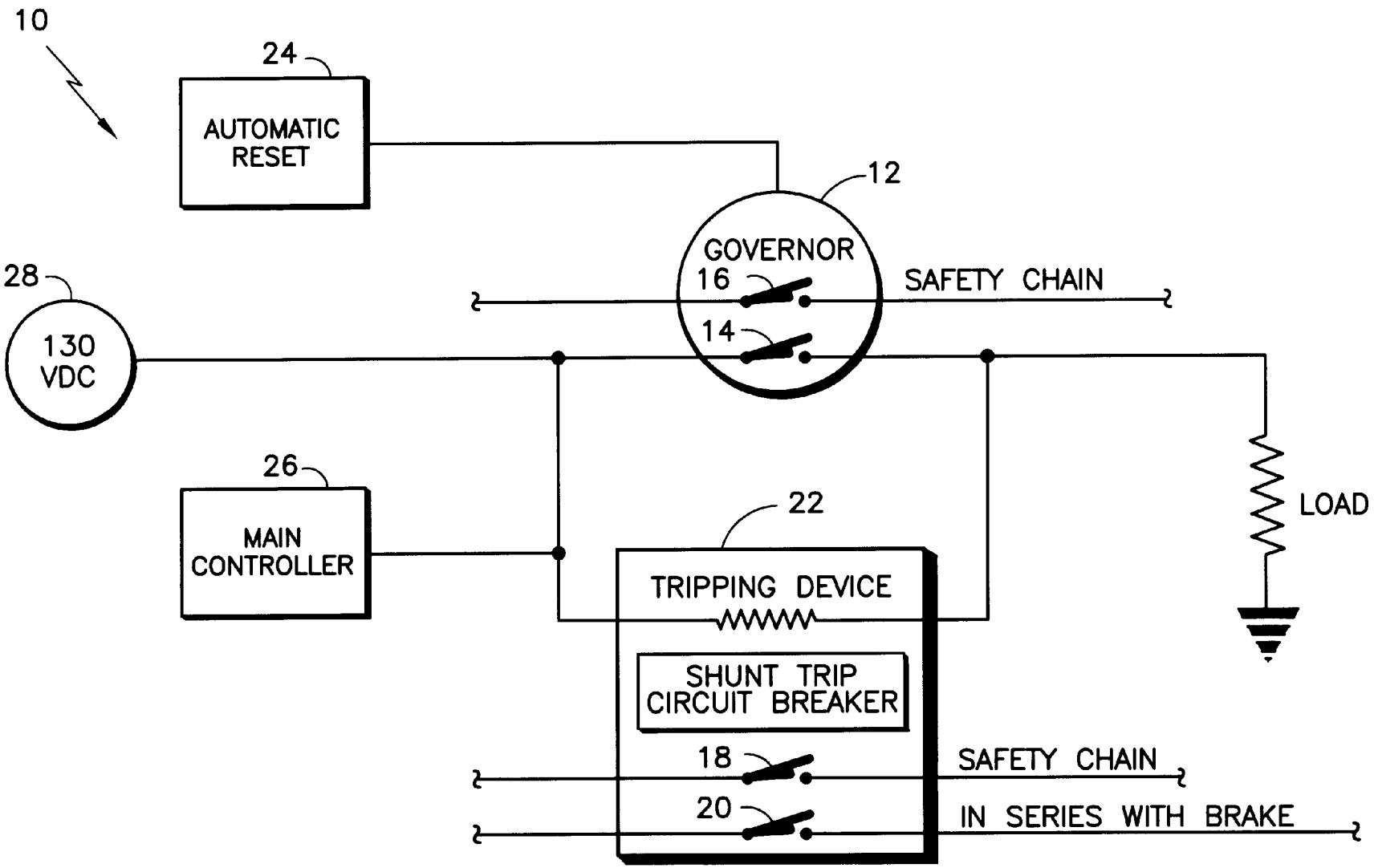
LOAD
SAFETY CHAIN
IN SERIES WITH BRAKE
SAFETY CHAIN
12
GOVERNOR
16
14
22
TRIPPING DEVICE
SHUNT TRIP CIRCUIT BREAKER
18
20
24
AUTOMATIC RESET
26
MAIN CONTROLLER
10
28
130 VDC

REMOTE STORAGE AND RESET OF ELEVATOR OVERSPEED SWITCH

RELATED APPLICATIONS

This patent application is related to a co-pending patent application titled "Elevator Rescue System", U.S. patent application Ser. No. 09/277,495, which is assigned to the assignee of the present application.

TECHNICAL FIELD

The present invention relates to elevators and, more particularly, to an overspeed switch system for an elevator.

BACKGROUND AND SUMMARY OF THE INVENTION

Conventional elevator safety equipment includes an overspeed governor for impeding elevator car movement when a predetermined speed is exceeded. Overspeed governors include a switch that opens when the elevator reaches a predetermined overspeed such as 110% of rated speed. When the switch opens, power is removed from the machine motor and brake. A braking mechanism, actuated in response to movement of the elevator car by motion transmission means, impedes the elevator car. The switch remains open, and the elevator remains inoperable, until the switch is manually re-set.

Typical governor designs include a sheave coupled to a rope attached to the elevator car, whereby the sheave moves in response to rope movement indicative of elevator car movement. The sheave drives a shaft or spindle coupled to an actuation mechanism. The actuation mechanism may be a set of flyballs or flyweights adapted to extend radially when a predetermined level of centrifugal force is applied to them. Radial extension of the flyballs or flyweights causes them to contact an overspeed switch When the overspeed switch is actuated, power to the motor and motor brake is cut, thereby causing the motor brake to apply a braking force on the motor shaft. If the elevator car continues to increase in speed, a tripping assembly is triggered by the fly weights. The tripping assembly actuates a mechanism to brake the governor rope. Braking of the governor rope causes the Safeties to be engaged and thereby stop the car.

Because the overspeed switch remains open until it is manually re-set, the elevator machine and brake power are not restored and the elevator system remains inoperable. In conventional elevator systems having machine rooms the switch to be re-set is conveniently accessible in the machine room by a technician. Typically, the governor is located in an overhead machine room.

In more recently developed "machine room-less" elevator systems, where the conventional machine room is eliminated, the governor and various other components are located in the hoistway. With the governor in the hoistway, the task of accessing and re-setting a governor overspeed switch is time-consuming, complicated, and costly. Although a solution may be to provide a special door or hatch to access a governor in a hoistway, such a solution adds cost and space requirements.

It is an object of the present invention to provide an overspeed switching system that operates safely and reliably, while reducing time and cost of restoring an elevator to operation after the overspeed switch has been tripped. These objects and others are achieved by the present invention.

The present invention is directed to an overspeed switch system for an elevator where a first switch located in the governor is tripped in response to detected overspeed, and the tripping of the first switch causes a second, remotely located switch to be tripped, whereby when either or both switches are open, power to the elevator system is shut down. The first switch is provided with automatic re-set means, while the second switch is manually re-set in an easily accessible, remote location such as a control panel in a landing.

BRIEF DESCRIPTION OF THE DRAWINGS

The sole FIGURE is a schematic diagram of a preferred embodiment of a switching system according to the present invention.

DESCRIPTION OF THE PREFERRED EMBODIMENTS

A schematic diagram of a preferred embodiment of the present invention overspeed switching system (10) is illustrated in FIG. 1. The system (10) includes a governor (12) that is responsive to elevator car speed through conventional coupling means such as a governor sheave coupled to a rope that is attached to an elevator car, whereby the rope transmits elevator car speed to the governor. When a predetermined speed is exceeded conventional actuation means, such as centrifugal flyweights, trigger a first set of switches (14, 16) and, if the car speed continues to increase, cause actuation of conventional mechanical means to impede elevator car movement. The first set of switches (14, 16) may comprise one switch or any other number of switches, depending on various factors such as the degree of safety redundancy desired or the number of different components dependent upon overspeed conditions. For example, a "safety chain" electrically linking various components and associated switches may be implemented, whereby the opening of one switch renders the system inoperable. The first switch (14) of the first set, for example, may be for the purpose of tripping the remote overspeed switch while the second switch (16) of the first set may be directly in the safety chain.

The tripping of the first set of switches (14, 16) causes them to open and, as a result, power to the elevator machine and brake is cut, and mechanical braking means in the elevator machine impede elevator car movement. It is preferable that the first switch set (14, 16) comprises two monostable contacts located in the governor. The monostable contacts are configured to maintain contact, in a closed position, during normal operation. Implementing them in this way, as opposed to setting them in an open position during normal operation, reduces the possibility of malfunction in overspeed mode due to, for example, corrosion or contaminant build-up on exposed contacts.

When the first set of switches (14, 16) are tripped, they cause tripping of a second set of switches, (18, 20). The first set of switches (14, 16) may, for example, trip the second set of switches (18, 20) by causing power loss when a contact is broken in response to first switch tripping. The second set of switches (18, 20) is remotely located, preferably in a convenient and easily accessible location such as a control panel (22) in an elevator landing or in a building managers office or a security office.

The system (10) is configured so that when both sets or either set of switches are open, the elevator is inoperable. Thus, the first set of switches (14, 16) may be provided with automatic re-setting means (24) and configured to remain open long enough to cause tripping of the second set of switches (18, 20). The automatic re-setting means (24) may comprise, for example, a spring-loaded mechanism and/or a timing control.

While the second set of switches (18, 20) may comprise any number or variety of switches, it is preferable that the second switches (18, 20) are bistable switches. Bistable switches, as opposed to differential circuit breakers, reduce the possibility of problems associated with mixing of different types of signals, such as alternative and/or continuous while providing fast and reliable signal response. As discussed with regard to the first set of switches (14, 16), one of the second set of switches (18, 20) may be a safety chain switch (18) while the other one (20) is part of the overspeed control. The second set of switches (18, 20) remain in an untripped, closed position during normal operation of the elevator system.

By configuring the system (10) so that the second set of switches (18, 20) remain open until manually re-set, and so that the first set of switches (14, 16) automatically close after tripping the second set of switches (18, 20), all that is required to re-start the elevator system is to close, or re-set, the second set of switches (18, 20). By locating the second set of switches (18, 20) in a conveniently accessible panel (22), the system (10) can be quickly and conveniently re-set. In some instances, where the services of a skilled service technician are not otherwise required, the system (10) can be re-set without the need for a skilled technician.

Power to trip the second set of switches (18, 20) can be supplied from a main controller (26) during normal operation, and from the brake power supply (28) during rescue operations.

If desired, a software-based switch may be implemented that is triggered by the overspaced switch on the governor and remains latched until a service technician resets them.

While the preferred embodiment of the present invention has been herein described, it is understood and acknowledged that variation and modification may be made without departing from the scope of the presently claimed invention.

What is claimed is:

1. An overspeed switch system for an elevator system, said switch system comprising speed detection means for detecting elevator car speed;

first switch means tripped by said speed detection means detecting an elevator car speed that exceeds a predetermined speed;

second switch means tripped in response to tripping by said first switch means, whereby said elevator system is rendered inoperable until said first switch and said second switch are returned to untripped positions; and automatic switch re-set means for re-setting said first switch means after tripping of said second switch means.

2. An elevator system according to claim 1, wherein said speed detection means comprise an elevator governor.

3. An elevator system according to claim 1, wherein said second switch means are located remotely from said first switch means.

4. An elevator system according to claim 3, wherein said first switch means are located in said governor; and said second switch means are located remotely from said governor.

5. A method of performing an overspeed control procedure for an elevator system, said method comprising detecting an overspeed condition of an elevator car;

tripping a first switch in response to said overspeed condition:

tripping a second switch in response to the tripping of said first switch, wherein the tripping of one of said first switch or said second switch activates an overspeed condition mode; and automatically re-setting said first switch after said second switch is tripped.

6. A method according to claim 5, wherein said overspeed condition mode comprises shutting down of power supply to an elevator motor.

7. A method according to claim 5, further comprising re-setting said second switch after said first switch is re-set in order to return the elevator system to normal operation mode.

* * * * *